US009269287B2

(12) United States Patent
Dai et al.

(10) Patent No.: US 9,269,287 B2
(45) Date of Patent: Feb. 23, 2016

(54) METHOD AND SYSTEM FOR MEASURING THE RESPONSE TIME OF A LIQUID CRYSTAL DISPLAY

(71) Applicant: Shenzhen China Star Optoelectronics Technology Co., Ltd., Shenzhen, Guangdong (CN)

(72) Inventors: Ye Dai, Guangdon (CN); Chi-Tsung Kang, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 252 days.

(21) Appl. No.: 14/007,975

(22) PCT Filed: Jun. 27, 2013

(86) PCT No.: PCT/CN2013/078232

§ 371 (c)(1),
(2) Date: Sep. 27, 2013

(87) PCT Pub. No.: WO2014/146373

PCT Pub. Date: Sep. 25, 2014

(65) Prior Publication Data

US 2014/0285534 A1 Sep. 25, 2014

(30) Foreign Application Priority Data

Mar. 22, 2013 (CN) ..... 2013 1 0096561

(51) Int. Cl.

| | |
|---|---|
| ***G09G 5/10*** | (2006.01) |
| ***G09G 3/00*** | (2006.01) |
| *G09G 3/36* | (2006.01) |

(52) U.S. Cl.

CPC ..... *G09G 3/006* (2013.01); *G09G 3/3611* (2013.01); *G09G 2320/0252* (2013.01); *G09G 2360/145* (2013.01)

(58) Field of Classification Search

CPC ..... G09G 3/006; G09G 3/3611; G09G 2320/0252; G09G 2360/145

USPC ..... 345/75.2–102, 207, 208, 589, 690–692; 349/25, 33, 172; 315/169.3, 291; 313/501, 503

See application file for complete search history.

(56) References Cited

U.S. PATENT DOCUMENTS

| | | | | |
|---|---|---|---|---|
| 4,958,915 | A * | 9/1990 | Okada et al. | 345/97 |
| 6,862,012 | B1 * | 3/2005 | Funakoshi | G09G 3/2092 345/101 |
| 7,164,284 | B2 * | 1/2007 | Pan et al. | 324/754.23 |
| 7,239,093 | B2 * | 7/2007 | Hsieh | 315/291 |
| 7,397,483 | B1 * | 7/2008 | Sugiura | G06T 11/001 345/601 |
| 8,084,950 | B2 * | 12/2011 | Kawasaki | 315/169.3 |

(Continued)

*Primary Examiner* — Prabodh M Dharia

(57) ABSTRACT

A method and system for measuring the response time of an LCD are provided. The method comprises the following steps: step A: controlling the LCD to display a preset image; step B: obtaining the luminance of the LCD that is displaying the preset image, and outputting a luminance-time curve in which the luminance changes over the time; step C: correcting the luminance-time curve to obtain a corrected luminance-time curve, and calculating the response time of the LCD according to the corrected luminance-time curve. When implementing the present application, the measuring errors about the response time of the system for measuring the response time, which are resulted from using different actual luminance measuring devices, can be reduced or eliminated.

5 Claims, 4 Drawing Sheets

(56) References Cited

U.S. PATENT DOCUMENTS

2005/0277815 A1* 12/2005 Taniguchi et al. ..... 600/300
2007/0120876 A1* 5/2007 Nishida ..... G09G 3/2003 345/690
2007/0152934 A1* 7/2007 Maeda ..... 345/92
2007/0236432 A1* 10/2007 Benjamin et al. ..... 345/87
2008/0198181 A1* 8/2008 Kondo ..... G09G 3/3648 345/690
2009/0027327 A1* 1/2009 Urisu ..... 345/101
2009/0135304 A1* 5/2009 Inoue ..... G09G 3/3208 348/712
2009/0251450 A1* 10/2009 Yamato ..... G09G 3/3648 345/211
2010/0277452 A1* 11/2010 Muraki ..... 345/207
2013/0162817 A1* 6/2013 Bernal ..... 348/143
2013/0194494 A1* 8/2013 Chun ..... G09G 3/2059 348/453
2013/0278578 A1* 10/2013 Vetsuypens ..... G09G 3/20 345/207
2013/0315505 A1* 11/2013 Atkins ..... G06T 3/4007 382/300
2014/0044372 A1* 2/2014 Mertens ..... H04H 19/46 382/248

* cited by examiner

METHOD AND SYSTEM FOR MEASURING THE RESPONSE TIME OF A LIQUID CRYSTAL DISPLAY

FIELD OF THE INVENTION

The present invention relates to a technical field of measuring the characteristic of a liquid crystal display, and more particularly relates to a method and system for measuring the response time of a liquid crystal display.

BACKGROUND OF THE INVENTION

For a liquid crystal display (LCD), the response time indicates the speed when each pixel in the LCD responses to an input signal, i.e., the response time indicates the time consumed during the pixel transforming from black to white or from white to black, which is an important factor for determining the characteristic of the LCD. The response time directly affects the quality of the pictures, especially the motion pictures, displayed by the LCD. Thus, it is crucial to measure the response time for determining the characteristic of the LCD. Generally, for most of the LCDs, the response time is defined by the criteria 305-1 managed by the Video Electronics Standards Association (VESA). Specifically, two different gray levels (regarded as the gray level A and the gray level B below) are preset first. The change of the gray levels is corresponding to the change of the luminance of the LCD. The response time is referred to as the transition time during which the luminance is converting from an initial value to 90% of an objective value. Then, a rise time (Tr) and a fall time (Tf) are measured. During the rise time (Tr), the luminance is rising from 10% to 90% and the images displayed by the LCD are changing from the grey level A to the grey level B. During the fall time (Tf), the luminance is falling from 90% to 10% and the images displayed by the LCD are changing from the grey level B to the grey level A. The response time of the LCD is defined as the sum of the rise time (Tr) and the fall time (Tf).

At present, the general method for measuring the response time comprises: collecting motion optic signals on the LCD via an actual luminance measuring device (an optical sensor); drawing a luminance-time curve (a response time curve); obtaining the time period of the rise edge (from 10% to 90%) and the time period of the fall edge (from 90% to 10%) from the curve, which are regarded as the rise time and the fall time of the response time respectively.

Although the response time is defined such definitely, those skilled in the art often use different actual luminance measuring devices to measure the response time. Actual luminance measuring devices with different types and different models, such as Charge-Coupled Device (CCD), Photo Diode, Photomultiplier Tube (PMT) and the like, may be used in the system for measuring the response time. Since different actual luminance measuring devices have different luminance induction linearity, the response time measured by different actual luminance measuring devices will be different from each other, which in turn cause an error for the measurement result. FIG. 4 shows two normalized response time curve ranging from the 192 gray level to the 225 gray level, namely the luminance-changing-over-time curve, measured by OPT101 and S9219 photodiode respectively. The difference between the response time measured by the OPT101 and the response time measured by the S9219 is 8 ms, as shown in the circle label in FIG. 4, which is a big error in practice.

SUMMARY OF THE INVENTION

Aiming at the drawbacks in the prior art that the systems for measuring the response time which use different actual luminance measuring devices are different from each other, the object of the present application is to provide a method and system for measuring the response time of an LCD, which can correct the measuring data measured by different actual luminance measuring devices and reduce or eliminate the measuring errors resulted from using different actual luminance measuring devices.

In one embodiment, a method for measuring the response time of an LCD comprises the following steps:

step A: controlling the LCD to display a preset image;

step B: obtaining the luminance of the LCD that is displaying the preset image, and outputting a luminance-time curve in which the luminance changes over the time;

step C: correcting the luminance-time curve to obtain a corrected luminance-time curve, and calculating the response time of the LCD according to the corrected luminance-time curve.

In one aspect, the step B comprises:

obtaining first luminance values measured by a standard luminance measuring device;

obtaining second luminance values measured by an actual luminance measuring device, and outputting a second luminance value-time curve according to the change of the second luminance values over the time.

In one aspect, the step C comprises:

step C1: constructing a matching function with the first luminance values as the dependent variable and the second luminance values as the independent variable, and obtaining LCD luminance values according to the matching function, wherein the LCD luminance values are the corrected second luminance value;

step C2: correcting the second luminance value-time curve with the LCD luminance values to generate an LCD luminance value-time curve, and calculating the response time of the LCD according to the LCD luminance value-time curve, wherein the LCD luminance value-time curve is the corrected second luminance value-time curve.

In one aspect, the step C1 comprises the following substeps:

constructing a matching function in form of the equation $y=f(x)=A+Bx+Cx^2+Dx^3$, wherein the first luminance values are used as the dependent variable y, the second luminance values are used as the independent variable, and the A, B, C, D are constants;

calculating the values of the constants A, B, C and D through curve-fitting method to ascertain the matching function;

calculating a set of the first luminance values according to the matching function, wherein there is a one-to-one relationship between the first luminance values and the second luminance values, and the set of the first luminance values are referred as the LCD luminance values.

In one aspect, the step C2 comprises the following substeps:

obtaining the second luminance value-time curve;

substituting the LCD luminance values in the second luminance value-time curve to generate the LCD luminance value-time curve;

calculating the response time of the LCD according to the LCD luminance value-time curve.

In another embodiment, a method for measuring the response time of an LCD comprises the following steps:

step A: controlling the LCD to display a preset image;

step B: obtaining the luminance of the LCD that is displaying the preset image, and outputting an luminance-time curve in which the luminance changes over the time;

step C: constructing a matching function with first luminance values as the dependent variable and second luminance values as the independent variable; obtaining an LCD luminance value according to the matching function, wherein the LCD luminance values are the corrected second luminance value;

step D: correcting the second luminance value-time curve with the LCD luminance values to generate an LCD luminance value-time curve, and calculating the response time of the LCD according to the LCD luminance value-time curve, wherein the LCD luminance value-time curve is a corrected second luminance value-time curve.

In one aspect, the step C comprises the following substeps:

constructing a matching function in form of the equation $y=f(x)=A+Bx+Cx^2+Dx^3$, wherein the first luminance values are used as the dependent variable y, the second luminance values are used as the independent variable, and the A, B, C, D are constants;

calculating the values of the constants A, B, C and D through curve-fitting method to ascertain the matching function;

calculating a set of the first luminance values according to the matching function, wherein there is a one-to-one relationship between the first luminance values and the second luminance values, and the set of the first luminance values are referred as the LCD luminance values.

In one aspect, the step D comprises the following substeps:

obtaining the second luminance value-time curve;

substituting the LCD luminance values in the second luminance value-time curve to generate the LCD luminance value-time curve;

calculating the response time of the LCD according to the LCD luminance value-time curve.

In one embodiment, a system for measuring the response time of an LCD, comprises a server, a standard luminance measuring device, and an actual luminance measuring device, and the standard luminance measuring device and the actual luminance measuring device are electrically connected to the server respectively;

the server includes:

a control module for controlling the LCD to display a preset image;

a processing module for obtaining the luminance of the LCD that is displaying the preset image and outputting a luminance-time curve in which the luminance changes over the time; and a correcting module for correcting the luminance-time curve to generate a corrected luminance-time curve, and for calculating the response time of the LCD according to the corrected luminance-time curve.

In one aspect, the processing module comprises:

a first processing module for obtaining first luminance values measured by the standard luminance measuring device;

a second processing module for obtaining second luminance values measured by an actual luminance measuring device, and outputting a second luminance value-time curve according to the change of the second luminance values over the time.

In one aspect, the correcting module comprises:

a data computing module for constructing a matching function with the first luminance values as the dependent variable and the second luminance values as the independent variable, and for obtaining LCD luminance values according to the matching function, wherein the LCD luminance values are the corrected second luminance values;

a data processing module for correcting the second luminance value-time curve with the LCD luminance values to generate an LCD luminance value-time curve, and for calculating the response time of the LCD according to the LCD luminance value-time curve, wherein the LCD luminance value-time curve is the corrected second luminance value-time curve.

In one aspect, while the data computing module is constructing the matching function with the first luminance value as the dependent variable and the second luminance value as the independent variable to obtain the LCD luminance value, it is implementing the following operations:

constructing a matching function in form of the equation $y=f(x)=A+Bx+Cx^2+Dx^3$, wherein the first luminance values are used as the dependent variable y, the second luminance values are used as the independent variable, and the A, B, C, D are constants;

calculating the values of the constants A, B, C and D through curve-fitting method to ascertain the matching function;

calculating a set of the first luminance values according to the matching function, wherein there is a one-to-one relationship between the first luminance values and the second luminance values, and the set of the first luminance values are referred as the LCD luminance values.

In one aspect, while the data processing module is correcting the second luminance value-time curve with the LCD luminance values to generate the LCD luminance value-time curve and calculating the response time of the LCD according to the LCD luminance value-time curve, it is implementing the following operations:

obtaining the second luminance value-time curve;

substituting the LCD luminance values in the second luminance value-time curve to generate the LCD luminance value-time curve;

calculating the response time of the LCD according to the LCD luminance value-time curve.

When implementing the application, the following advantages can be achieved. In the method and system of the application, the measuring data of the actual luminance measuring device is corrected, and the values measured by different actual luminance measuring devices are used unifiedly. Therefore, the measuring errors of the system for measuring the response time which are resulted from using different actual luminance measuring devices can be reduced or even eliminated, which in turn reduces the manufacturing cost of the system.

BRIEF DESCRIPTION OF THE DRAWINGS

The method and system for measuring the response time of an LCD according to the present application will be further illustrated referring to the accompanying drawings and embodiments, in the drawings.

DETAILED DESCRIPTION OF THE PREFERRED EMBODIMENTS

A measuring system and a measuring method are provided in the application to measure the response time of an LCD. When implementing the measuring method and the measuring system provided in the present application, the error of the measuring system resulted from using different actual luminance measuring devices (optical sensors) would be reduced or even eliminated.

Figure 1:
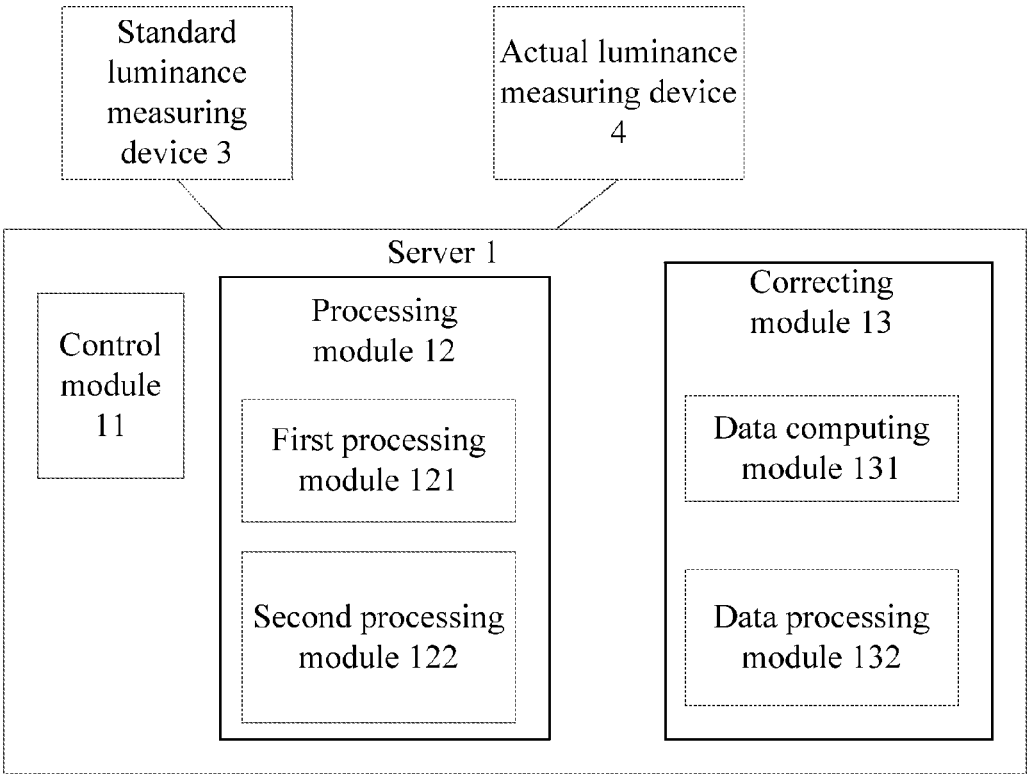
FIG. 1 is a block diagram of a system for measuring the response time of an LCD according to a preferred embodiment in the application.

FIG. 1 shows a block diagram of a system for measuring the response time of an LCD according to a preferred embodiment in the application. The system includes a server 1, a standard luminance measuring device 3 and an actual luminance measuring device 4. The standard luminance measuring device 3 and the actual luminance measuring device 4 are electrically connected to the server 1. The standard luminance measuring device 3, the actual luminance measuring device 4 and the server 1 are electrically connected to the LCD.

The standard luminance measuring device 3 is configured to measure the luminance of the LCD to generate first luminance values and report them to the server 1. The standard luminance measuring device 3 can measure the luminance values sensed by eyes. Therefore, the luminance values measured by the standard luminance measuring device 3 can be referred to as the standard luminance values in the LCD industry. The standard luminance measuring device 3 may be a CS2000-typed luminance analyzer or a CA310-typed color analyzer and the like. Generally, the luminance values can be calculated through measuring the gamma curve, i.e., the luminance-gray curve. The standard luminance values acquired by the standard luminance measuring device 3 are regarded as the first luminance values, and the first luminance values are converted from the optic signals into the voltage signals, and then the voltage signals are sent to the server 1. However, the standard luminance measuring device 3 only can detect the change of the first luminance values over the gray level, but not over the time.

The actual luminance measuring device 4 is configured to measure the luminance of the LCD 2 to generate second luminance values and report them to the server 1. Generally, the actual luminance measuring device 4 may be an optic sensor, such as a photodiode usually used as an optic sensor in the LCD industry, which can reduce the manufacturing cost of the system for measuring the response time. Of course, it may be other optic sensors with different types and different models, such as a CCD, a PMT and the like. Optic sensors with different types and different models have difference in the induction for the luminance. The luminance values induced by eyes are referred to as the reference values to judge whether the luminance values measured by different optic sensors are similar or not. The actual luminance measuring device 4 obtains the second luminance values through measuring the gamma curve, and it converts the second luminance values from the optic signals to the voltage signals and sends the voltage signals to the server 1. The actual luminance measuring device 4 further can detect the change of the second luminance values over the time, and send them to the server 1.

The server 1 specially includes a control module 11, a processing module 12 and a correcting module 13. The control module 11 is configured to control the LCD to display a preset image. The control module 11 is preferably provide a set of special image signals as light signals. In such case, the LCD would display the special image as an object to be measured. The processing module 12 is configured to obtain the luminance of the LCD that is displaying the image and output a luminance-time curve in which the luminance changes over the time. The processing module 12 includes a first processing module 121 and a second processing module 122. The first processing module 121 controls the standard luminance measuring device 3 to measure the luminance of the LCD, and it acquires the first luminance values measured and reported by the standard luminance measuring device 3. The second processing module 122 controls the actual luminance measuring device 4 to measure the luminance of the LCD, and it acquires the second luminance values measured and reported by the actual luminance measuring device 4. The second processing module 122 further outputs a second luminance value-time curve according to the change of the second luminance values over the time. The correcting module 13 is configured to correct the luminance-time curve to generate a corrected luminance-time curve, and calculate the response time of the LCD according to the corrected luminance-time curve. The correcting module 13 includes a data computing module 131 and a data processing module 132. The data computing module 131 constructs a matching function with the first luminance values as the dependent variable and the second luminance values as the independent variable, in order to obtain the LCD luminance values, namely the corrected second luminance values. The data computing module 131 exerts the following operations: constructing a matching function in form of the equation $y=f(x)=A+Bx+Cx^2+Dx^3$, wherein the first luminance values are used as the dependent variable y, the second luminance values are used as the independent variable x, and the A, B, C, D are constants; calculating the values of the constants A, B, C and D through curve-fitting method to ascertain the matching function; calculating a set of the first luminance values according to the matching function, wherein there is a one-to-one relationship between the first luminance values and the second luminance values, and the set of the first luminance values are referred as the LCD luminance values. The data processing module 132 is configured to correct the second luminance value-time curve with the LCD luminance values to generate an LCD luminance value-time curve, and calculate the response time of the LCD according to the LCD luminance value-time curve, wherein the LCD luminance value-time curve is the corrected second luminance value-time curve. The data processing module 132 exerts the following operations: obtaining the second luminance value-time curve; substituting the LCD luminance values in the second luminance value-time curve to generate the LCD luminance value-time curve; calculating the response time of the LCD according to the LCD luminance value-time curve.

Figure 2:
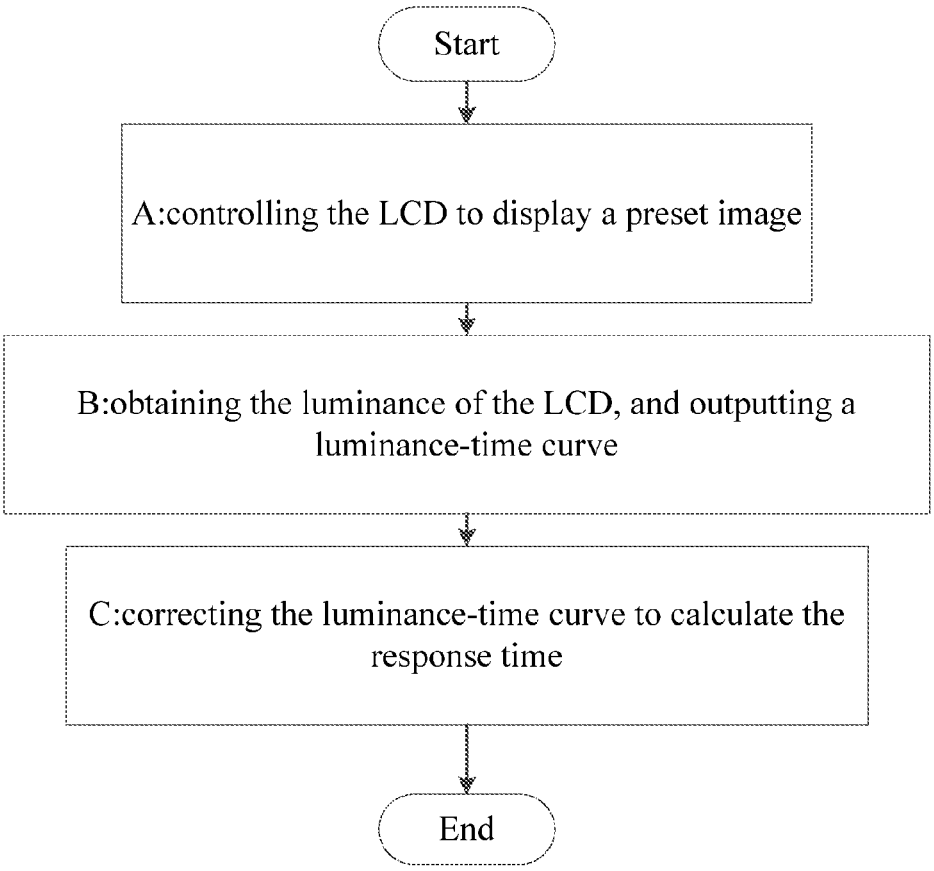
FIG. 2 is a flow chart of a method for measuring the response time of an LCD according to a preferred embodiment in the application.

FIG. 2 shows a flow chart of a method for measuring the response time of an LCD of the application.

step A: controlling the LCD to display a preset image.

step B: obtaining luminance values of the LCD, and outputting a luminance-time curve in which the luminance changes over the time. Specifically, the standard luminance measuring device 3 measures the luminance of the LCD that is displaying the preset image. The actual luminance measuring device 4 measures the luminance of the LCD that is displaying the preset image and the change of the luminance over the time. The server 1 obtains the first luminance values of the LCD which are measured by the standard luminance measuring device 3 and the second luminance values of the LCD which are measured by the actual luminance measuring device 4, and it then draws a second luminance value-time curve.

step C: correcting the luminance-time curve to generate a corrected luminance-time curve, and calculating the response time of the LCD according to the corrected luminance-time curve.

Figure 3:
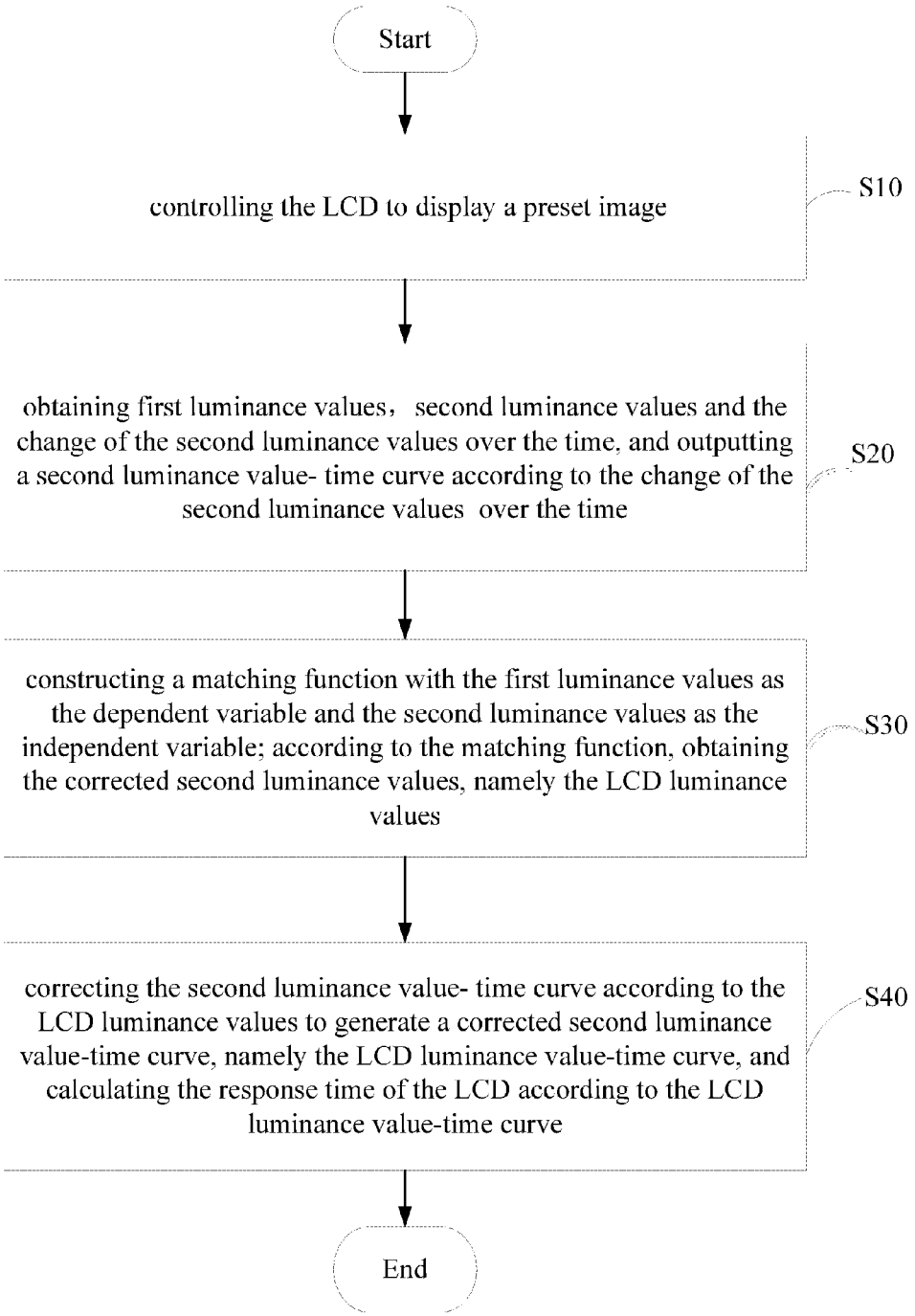
FIG. 3 is a detail flow chart for FIG. 2.

Referring to FIG. 3, the method for measuring the response time of the LCD is described more detail.

S10: the LCD is controlled to display a preset image when the response time of the LCD is being measured. The preset image is provided by the server 1. To get a better measuring result, the control module 11 of the server 1 provides a special pattern to displayed on the LCD as a light signal.

S20: an industry-standard standard luminance measuring device 3 measures the luminance values of the above LCD, specifically acquires the luminance values (namely the first luminance values) of the LCD from the measured gamma curve (namely the luminance-grey curve) and reports them to the processing module 12 in the server 1; an actual luminance measuring device 4 measures the luminance values of the above LCD, specifically acquires the luminance values (namely the second luminance values) of the LCD from the measured gamma curve (namely the luminance-grey curve) and reports them to the processing module 12 in the server 1; the actual luminance measuring device 4 detects the change of the second luminance values over the time and reports the change to the processing module 12 in the server 1, and then the processing module 12 outputs the second luminance value-time curve according to the change of the second luminance values over the time. Since the first luminance values and the second luminance values are voltage signals, the processing module 12 needs to convert the voltage signals into digital signals and send the digital signals to the correcting module 13.

S30: the data computing module 131 in the correcting module 13 constructs a matching function to show the relationship between the second luminance value and the first luminance value. The form of the matching function may be defined as $y=f(x)=A+Bx+Cx^2+Dx^3$, wherein, the first luminance values are regarded as the dependent variable y and the second luminance values are regarded as the independent variable x, and the A, B, C and D are constants. Of course, the form of the matching function also can be defined as power functions such as $y=f(x)=A+Bx+Cx^2+Dx^3+Ex^4$ or index functions such as $y=y_0+Ae^{-x/t}$. In a word, the form of the matching function can be any common mathematical function. Since the matching function $y=f(x)=A+Bx+Cx^2+Dx^3$ can meet the request, a more complex function that may increase the difficulty in calculating is not needed. The values of the constants A, B, C, and D can be calculated based on the curve fitted by the common method of least square, wherein the method of least square is adopted by the curve fitting capability of the mathematical analyzing software such as Matlab or Origin, as a result, the matching function can be determined. According to the determined matching function, the second luminance values x measured by the actual luminance measuring device can be converted into their corresponding first luminance values y one by one. Then, a set of the first luminance values y is constructed, which can be referred to as the LCD luminance values, namely the corrected second luminance values. The LCD luminance values are sent to the data processing module 132.

S40: the data processing module 132 in the correcting module replaces the second luminance values in the second luminance value-time curve by the LCD luminance values, and it outputs a new LCD luminance value-time curve. In the curve, the time values are regarded as the values of x, and each second luminance value corresponding to a value of x is replaced by each corrected LCD luminance value. The time consumed during the period in which the luminance rises from 10% to 90% and the time consumed during the period in which the luminance falls from 90% to 10% are calculated according to the new LCD luminance value-time curve, the sum of which is regarded as the corrected response time (the method for calculating the response time is the calculating method defined in the industry standard that is known to those skilled in the art, so it will not be described further).

The method is described more detail by the following example. The S9219-typed and OPT101-typed photodiode are selected as the actual luminance measuring devices 4 respectively to obtain the gamma curve of the LCD, pick up the luminance values as the second luminance values and report them to the server 1. The CA310-typed standard luminance measuring device 3 is selected to obtain the gamma curve of the LCD, pick up the luminance values as the first luminance values and report them to the server 1. The server 1 constructs two matching functions. One of the matching functions shows the relationship between the first luminance values and the second luminance values that are measured by the S9219-typed photodiode. The other matching function shows the relationship between the first luminance values and the second luminance values that are measured by the OPT101-typed photodiode. The forms of both functions are represented as $y=f(x)=A+Bx+Cx^2+Dx^3$. The values of the constants in the matching functions of two photodiodes are shown in the following table, which are calculated through curve fitting of the mathematical analyzing software such as Matlab or Origin.

TABLE 1

| S9219 | OPT101 |
|---|---|
| A = −2.9845 | A = 6.19805 |
| B = 227.0205 | B = −43.0716 |
| C = 665.2955 | C = 100.2694 |
| D = −546.917 | D = −16.4014 |

Therefore, the matching function corresponding to the S9219-typed photodiode is:

$$y=f(x)=-2.9845+227.0205x+665.2955x^2-546.917x^3 \quad (1),$$

the matching function corresponding to the OPT101-typed photodiode is:

$$y=f(x)=6.19805-43.0716x+100.2694x^2-16.4014x^3 \quad (2);$$

The luminance values reported by the S9219-typed photodiode are regarded as the values of x. A set of the first luminance values y, regarded as the corrected LCD luminance values, are calculated according to the equation (1), wherein there is a one-to-one relationship between the first luminance values and the second luminance values. Similarly, the luminance values reported by the OPT101-typed photodiode are regarded as the values of x. A set of the first luminance values y, regarded as the corrected LCD luminance values, are calculated according to the equation (2), wherein there is a one-to-one relationship between the first luminance values and the second luminance values.

Figure 4:
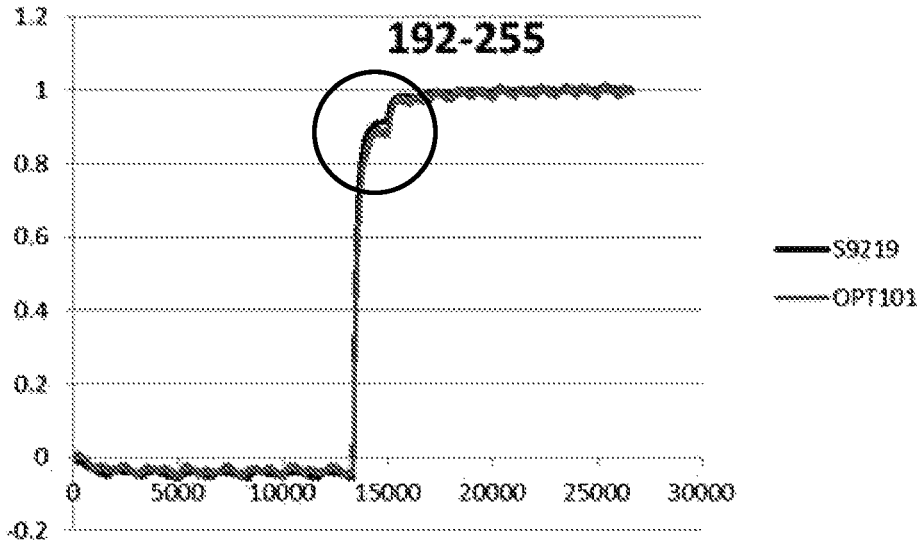
FIG. 4 is an uncorrected response time curve of an LCD obtained by the S9219-type photodiode and the OPT101-type photodiode.
Figure 5:
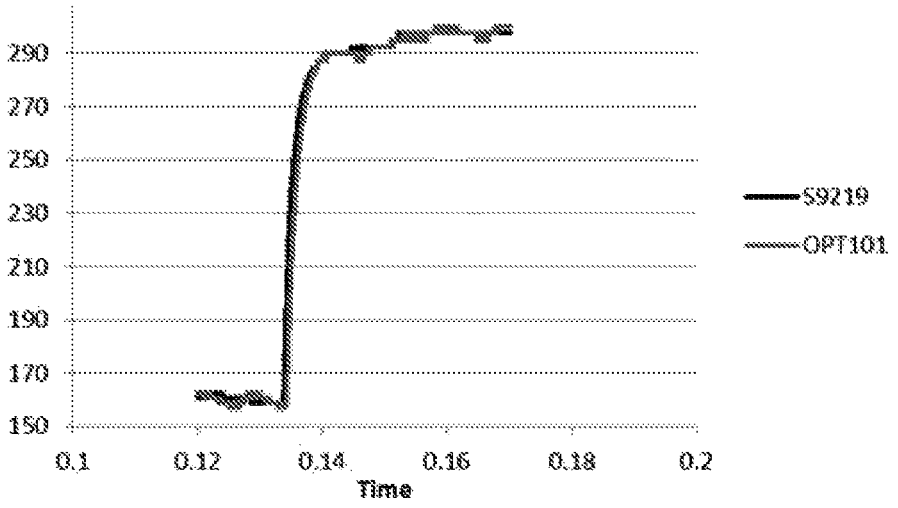
FIG. 5 is a corrected response time curve of an LCD obtained by the S9219-type photodiode and the OPT101-type photodiode.

The S9219-typed photodiode and the OPT101-typed photodiode respectively report the change of the luminance values over the time to the server 1. The sever 1 replaces the luminance values in two luminance values-time curves by the corresponding corrected LCD luminance values respectively, and it outputs the new LCD luminance value-time curve shown in FIG. 5. The response time measured by the two types of actual luminance measuring devices 4 are generally the same. However, the uncorrected response time curve is shown in FIG. 4, which shows that the difference between the response time measured by the S9219 and the response time measured by the OPT101 is 8 ms.

It should be understood by those skilled in the art that various changes may be made and equivalents may be substituted without departing from the scope of the present application. However, all the changes will be included within the scope of the appended claims.

The invention claimed is:

1. A method for measuring the response time of an LCD, comprising the following steps:

step A: the LCD displaying a preset image in a controlled manner;

step B: obtaining a first and second luminance values of the LCD when displaying the preset image, and outputting a luminance-time curve in which the second luminance value changes over the time; wherein, the first and second luminance values are respectively measured by a standard luminance measuring device and an actual luminance measuring device, the standard luminance measuring device is configured to measure a luminance-gray scale characteristic of the LCD, and the actual luminance measuring device is configured to measure a luminance-time characteristic of the LCD; and step C: correcting the luminance-time curve to obtain a corrected luminance-time curve by replacing the second luminance value in the luminance-time curve with a corrected luminance value, and calculating the response time of the LCD according to the corrected luminance-time curve; wherein the corrected luminance value is obtained with the following steps:

step C1: constructing a matching function between the first luminance value and the second luminance value, wherein the first luminance value is a dependent variable and the second luminance value is an independent variable; and step C2: calculating the corrected luminance value according to the matching function constructed, wherein the corrected luminance value is the dependent variable and the second luminance value is the independent variable.

2. The method for measuring the response time of an LCD according to claim 1, wherein, the step C1 comprises the following sub-steps:

constructing the matching function in form of an equation $y=f(x)=A+Bx+Cx^2+Dx^3$, wherein the first luminance value is used as the dependent variable y, the second luminance value is used as the independent variable x, and the A, B, C, D are constants;

calculating the values of the constants A, B, C and D through curve-fitting method to ascertain the matching function.

3. A system for measuring the response time of an LCD, comprising a server, a standard luminance measuring device configured to measure a luminance-gray scale characteristic of the LCD and to output a first luminance value to the server, and an actual luminance measuring device configured to measure a luminance-time characteristic of the LCD and to output a second luminance value to the server;

wherein, the standard luminance measuring device and the actual luminance measuring device are electrically connected to the server respectively;

wherein, the server includes:

a control module for controlling the LCD to display a preset image;

a processing module for obtaining the first and second luminance values of the LCD that is displaying the preset image and outputting a luminance-time curve in which the second luminance value changes over the time; and a correcting module for correcting the luminance-time curve to generate a corrected luminance-time curve by replacing the second luminance value in the luminance-time curve with a corrected luminance value, and for calculating the response time of the LCD according to the corrected luminance-time curve;

and wherein, the correcting module comprises:

a data computing module for constructing a matching function between the first luminance value and the second luminance value, wherein the first luminance value is a dependent variable and the second luminance value is an independent variable, and for calculating the corrected luminance value according to the matching function constructed, wherein the corrected luminance value is the dependent variable and the second luminance value is the independent variable; and a data processing module for correcting the luminance-time curve to generate the corrected luminance-time curve by replacing the second luminance value in the luminance-time curve with the corrected luminance value calculated, and for calculating the response time of the LCD according to the corrected luminance-time curve.

4. The system for measuring the response time of an LCD according to claim 3, wherein, the processing module comprises:

a first processing module for obtaining the first luminance value measured by the standard luminance measuring device;

a second processing module for obtaining the second luminance value measured by the actual luminance measuring device, and outputting the luminance time curve according to the change of the second luminance value over the time.

5. The system for measuring the response time of an LCD according to claim 3, wherein, while the data computing module is constructing the matching function to obtain the corrected luminance value, the following operations are implemented:

constructing the matching function in form of an equation $y=f(x)=A+Bx+Cx^2+Dx^3$, wherein the first luminance value is used as the dependent variable y, the second luminance value is used as the independent variable x, and the A, B, C, D are constants;

calculating the values of the constants A, B, C and D through curve-fitting method to ascertain the matching function;

calculating the corrected luminance value according to the matching function, wherein the corrected luminance value is the dependent variable and the second luminance value is the independent variable.

* * * * *